US005198406A

United States Patent [19]

Mack et al.

[11] Patent Number: 5,198,406

[45] Date of Patent: Mar. 30, 1993

[54] TRANSPARENT THERMOGRAPHIC RECORDING FILMS

[75] Inventors: Jonathan M. Mack, Boylston; Kang Sun, North Attleboro, both of Mass.

[73] Assignee: Polaroid Corporation, Cambridge, Mass.

[21] Appl. No.: 808,540

[22] Filed: Dec. 16, 1991

Related U.S. Application Data

[63] Continuation-in-part of Ser. No. 725,433, Jul. 3, 1991, abandoned.

[51] Int. Cl.[5] ..... B41M 5/32; B41M 5/30

[52] U.S. Cl. ..... 503/207; 503/200; 503/210; 503/214; 503/217; 503/220; 503/224; 503/226

[58] Field of Search ..... 503/200, 207, 210, 214, 503/217, 220, 224, 226

[56] References Cited

U.S. PATENT DOCUMENTS

| | | | |
|---|---|---|---|
| 2,956,958 | 10/1960 | Iler | 252/313 |
| 4,583,103 | 4/1986 | Hayashi et al. | 346/209 |
| 4,820,682 | 4/1989 | Shimomura et al. | 503/207 |
| 4,904,572 | 2/1990 | Dombrowski, Jr. et al. | 430/332 |
| 4,985,394 | 1/1991 | Mori et al. | 503/226 |

FOREIGN PATENT DOCUMENTS

| | | |
|---|---|---|
| 250558 | 2/1990 | European Pat. Off. . |
| 2210702 | 6/1989 | United Kingdom . |

OTHER PUBLICATIONS

Iler, R. K., The Chemistry of Silica, John Wiley & Sons, NY, 1979, pp. 369–372.

*Primary Examiner*—Patrick J. Ryan
*Assistant Examiner*—Elizabeth Evans
*Attorney, Agent, or Firm*—Carol A. Loeschorn

[57] ABSTRACT

This invention provides transparent thermographic recording films which exhibit good anti-stick properties, are scratch resistant and substantailly craze-free. The thermographic recording films comprise a transparent support carrying (a) a dye image-forming system comprising a di- or triarylmethane thiolactone dye precursor, an organic silver salt, a heat-fusible organic acidic material, and polyvinylbutyral as the binder; and, (b) a protective topcoat layer positioned above said dye image-forming system and comprising a water-insoluble polymeric binder, a mixture of at least two colloidal silicas having different average particle diameters in the proportion, by weight, of 1 part of silica having an average diameter of 50 nm or smaller and 0.3 to 1 part of silica particles having an average diameter no more than 40% of the larger sized silica particles, the ratio of total silica to binder being at least 3 parts per weight silica to 1 part per weight binder. One of the colloidal silicas may be a fumed colloidal silica. An organofunctional silane may be added to the protective topcoat layer or coated as a separate layer on top of the protective topcoat layer.

26 Claims, No Drawings

TRANSPARENT THERMOGRAPHIC RECORDING FILMS

CROSS-REFERENCE TO RELATED APPLICATION

This application is a continuation-in-part of copending application Ser. No. 725,433, filed July 3, 1991, now abandoned.

BACKGROUND OF THE INVENTION (1) Field of the Invention

The present invention relates to transparent thermographic recording films, and more specifically, it relates to a topcoat for transparent thermographic recording films which are to be imaged with a thermal printhead and which exhibit good anti-stick properties, are scratch resistant, water resistant, substantially craze-free and low in haze.

(2) Description of the Related Art

Color-forming di- and triarylmethane compounds possessing certain S-containing ring closing moieties, namely a thiolactone, dithiolatone or thioether ring closing moiety are disclosed in European Patent No. 250,558 and U.S. Pat. No. 4,904,572. These dye precursors undergo coloration by contacting with a Lewis acid material, preferably a metal ion of a heavy duty, particularly silver, capable of opening the S-containing ring moiety to form a colored metal complex.

As disclosed in the above-cited European Patent, the ability of these dye precursors to form a colored dye almost instantaneously when contacted with $Ag+$ renders them eminently suitable for use as color formers in thermal imaging systems employing organic silver salts, such as silver behenate. In these systems, color formation is particularly efficient since it is effected by a phase change, i.e., effected by the melting of the organic silver salt to provide the $Ag+$ necessary for coloration rather than requiring a change of state.

As disclosed in European Patent No. 250,558, mentioned above, these thermographic recording films preferably include a heat-fusible organic acid material. U.S. Pat. No. 4,904,572 discloses 3,5-dihydroxybenzoic acid as a preferred heat-fusible organic acid.

The above described thermal color-forming system requires a thermoplastic binder, e.g. polyvinylbutyral, in order for the image-forming chemistry to function in a thermal printing environment. When imagewise heating is accomplished by means of a thermal printhead, the thermoplastic binder is in direct contact with the thermal printhead during imaging. Since thermoplastic binders soften upon the application of heat, they tend to stick to the thermal printhead during imaging.

This "sticking" interferes with the printing, adversely effects image quality, and can cause damage to the printhead.

A number of ways to prevent sticking between a binder and a thermal printhead during printing have been suggested for various thermographic recording films. Many of these employ a protective or anti-stick topcoat comprising silica over the thermographic color-forming layer. These topcoats contact the thermal printhead during imaging to prevent "sticking". Another way to prevent sticking has been to employ a surface active agent to add anti-stick properties. However, these silica containing topcoats and surface-active agents have drawbacks and/or do not perform adequately when the binder employed in the coloring system is polyvinylbutyral and the support used for the thermosensitive recording film is a transparent support.

For example, low surface energy materials such as silicone polymers exhibit good anti-stick properties. However, the useful silicone polymers are relatively low molecular weight silicone polymers which have a tendency to be migratory and thus cause problems, e.g., they transfer to the back of the film if it is rolled for storage or to the back of the adjacent film if stored in sheets. In addition, because these silicones are polymers, their properties change with changes in moisture and temperature and therefore, their performance is not consistent under all conditions.

U.S. Pat. No. 4,583,103 issued Apr. 15, 1986 and U.S. Pat. No. 4,820,682 issued Apr. 11, 1989 disclose protective topcoats for heat-sensitive recording papers containing a binder comprising silicon modified polyvinylalcohol and colloidal silica and/or amorphorous silica. The above patents also disclose topcoats wherein said colloidal silica contains silica grains having an average particle size of from about 10 millimicrons (mμ) to 100 mμ (1 mμ = 1 nanometer (nm)) and the amorphous silica has primary grain size of about 10 micrometers (μm) to 30 μm (1 μm − $10^3$ nm). These topcoats are disclosed as providing good printing densities, resistance to various chemicals, oils and water, and anti-sticking and anti-blocking properties. In addition, the latter patent discloses the topcoat as exhibiting excellent transparency and describes it for use on a transparent base. However, the lowest level of haze reported is 16%, a level which is higher than desirable for overhead transparency (OHT) applications.

Published UK Patent Application No. 2,210,702 having a publication data of June 14, 1989 and assigned to the same assignee as the latter two patents, discloses a heat-sensitive recording material which, when it employs a topcoat as described above, e.g., silicon modified polyvinylalcohol and colloidal silica, reports a level of haze as low as 8%.

However, when polyvinylbutyral is used as the binder for the color-forming materials of this invention, and a topcoat as described above, i.e. silicon modified polyvinylalcohol and colloidal silica, is employed to prevent sticking, there is poor adhesion between the topcoat and underlying polyvinylbutyral layer, as well as poor scratch resistance of the resulting film. In addition, the silicon modified polyvinyl alcohol binder is water soluble and can be rubbed off with water.

U.S. Pat. No. 4,985,394 issued Jan. 15, 1991 discloses a topcoat for a thermosensitive recording material which comprises at least one inorganic pigment selected from the group consisting of silica and calcium carbonate, each having an average particle diameter of 0.1 μm or less, and a water-soluble binder, formed on the thermosensitive coloring layer. Many of these topcoats have problems of inadequate transparency and/or adhesion when coated over the polyvinylbutyral color-forming layer of the present invention.

Thus, a hard, durable topcoat is required which can be placed over the polyvinylbutyral color-forming layer(s) to prevent sticking of the polyvinylbutyral to the thermal printhead during printing, and which is resistant to scratching and crazing and also exhibits high transparency.

SUMMARY OF THE INVENTION

The present invention provides transparent thermographic recording films which exhibit good resistance to sticking during printing, are resistant to scratching and crazing and which have excellent transparency, and good wet rub resistance.

The thermographic recording film of the present invention employ a transparent support; a color-forming component comprising a thiolactone dye precursor, an organic silver salt, a heat-fusible organic acidic material and polyvinylbutyral as the binder; and, a transparent, anti-stick topcoat layer comprising a mixture of at least two colloidal silicas having different average particle diameters in the proportion, by weight, of 1 part of silica having an average diameter of 50 nm or smaller and 0.3 to 1 part of silica particles having an average diameter no more than 40% of the larger sized silica particles, the ratio of total silica to binder being at least 3 parts per weight silica to 1 part per weight binder.

One of the colloidal silicas may be a fumed colloidal silica having an average particle diameter in the range of 14–30 nm, preferably 14–15 nm.

The thermographic recording materials according to the present invention may additionally comprise an organofunctional silane in said topcoat layer or added as a separate layer on top of said topcoat layer.

DETAILED DESCRIPTION OF THE INVENTION

The transparent thermographic recording films according to this invention comprise a transparent support carrying:

(a) a dye image-forming system comprising a di- or triarylmethane thiolactone dye precursor, an organic silver salt, a heat-fusible organic acidic material, and polyvinylbutyral as the binder; and, (b) a protective topcoat layer layer positioned above said dye image-forming system and comprising a water-insoluble polymeric binder, a mixture of at least two colloidal silicas having different average particle diameters in the proportion, by weight, of 1 part of silica having an average diameter of 50 nm or smaller and 0.3 to 1 part of silica particles having an average diameter no more than 40% of the larger sized silica particles, the ratio of total silica to binder being at least 3 parts per weight silica to 1 part per weight binder.

One of the colloidal silicas employed in the present invention may be a fumed colloidal silica. Fumed colloidal silica is branched, three-dimensional, chain-like agglomerates of silicon dioxide. The agglomerates are composed of many primary particles which have fused together. Fumed silica is produced by the hydrolysis of silicon tetrachloride vapor in a flame of hydrogen and oxygen. The fumed colloidal silica is referred to as "fumed" silica because of its smoke-like appearance as it is formed. If fumed colloidal silica is employed, an average particle diameter in the range of 14–30 nm is generally used, preferably 14–15 nm.

Silicas having an average diameter of 50 nm or less are required to be used in the present invention. Employing silicas having an average diameter in excess of 50 nm results in inferior transparent thermographic recording films having higher levels of haze and hence films which are not as transparent. For OHT applications, it is desired that the thermographic recording films have a measured level of haze less than 10%, and preferably less than 5%. It is preferred that the largest sized colloidal silica employed in the present invention be at least 20 nm in diameter, unless fumed colloidal silica is used as the largest sized silica in which case, it is preferred that the fumed colloidal silica be at least 14 nm in diameter.

The mixture of silicas is required to give the hardness and durability necessary to prevent sticking of the polyvinylbutyral to the thermal printhead, to inhibit scratching on the surface of the thermographic recording film and to limit crazing, i.e., cracking on the surface of the film.

If only one silica of a specified average diameter is used in the present invention, the problems mentioned earlier occur. That is, if only silicas having an average diameter of the larger said silicas specified by this invention are employed, e.g., an average diameter of 50 nm, a topcoat of inadequate hardness and durability is obtained. The resulting thermographic recording film is more susceptible to scratching e.g., by fingernails and/or by the thermal printhead, and to gouging.

Employing only one silica having an average diameter of one of the smaller sized silica specified by this invention, e.g., 5 nm, results in a hard, scratch-resistant topcoat; however, it exhibits a high level of crazing.

A preferred topcoat of the present invention is one wherein the largest sized colloidal silica is a fumed colloidal silica having an average particle diameter in the range of 14–30 nm, preferably 14–15 nm. The fumed colloidal silica, because of its networked structure, has the advantage of tight packing with the smaller sized silica, e.g. 5 nm colloidal silica, to give a tough, non-gouging, crack-resistant surface. In addition, the tighter packed, networked structure results in superior print quality by reducing gouging, decreasing chatter and enhancing the scratch resistance during printing of the image relative to recording films which do not employ fumed colloidal silica. However, fumed colloidal silica imparts somewhat more haze to the system when compared with the other colloidal silicas as specified according to the present invention.

Fumed colloidal silica has been found to be particularly preferred for use with thermal printers such as Model TDU 850 commercially available from Raytheon Company, Submarine Signal Division, Portsmouth, R.I.

Another preferred topcoat of this invention comprises a mixture of 3 different sized colloidal silica particles in the proportion by weight of 1 part silica particles having an average diameter of 50 nm or smaller, and 0.2 to 0.6 part of silica particles having an average diameter of no more than 40% of the larger sized silica particles, and 0.2 to 0.6 part of silica particles having an average diameter no larger than 8 nm. A particularly preferred topcoat comprises a mixture of 1 part silica having an average diameter of 50 nm, 0.6 part of silica having an average diameter of 20 nm and 0.6 part of silica having an average diameter of 5 nm.

Water-insoluble binders are required in the topcoats of the present invention. If water-soluble binders, e.g. polyvinylalcohol (PVA) and silicon modified PVA, are employed in the topcoats, there is poor adhesion between the topcoat and polyvinylbutyral color-forming layers. This results in inadequate scratch-resistance and in extreme cases, allows the two layers to be peeled apart from each other.

The water-insoluble binders for use in the present invention include aliphatic polyurethanes, styrene-maleic anhydride copolymers, polyacrylic acid, polyacrylic latex emulsions, polyvinylidene chloride copolymer emulsions and styrene-butadiene copolymer emulsions. A single binder or a combination of one or more binders can be employed.

To prevent interaction of the components in the topcoat layer with those in the solvent soluble color-forming layer beneath it, and to ameliorate the environmental concerns associated with coating from solvents, the topcoats of this invention are preferably coated out of aqueous systems. Since the binders employed are water-insoluble, they are either coated as latex emulsions or they are made water soluble by mixing with alkali, preferably aqueous ammonia which is lost upon drying. After drying, the resulting water-insoluble topcoat is advantageous in that it has enhanced wet rub resistance.

The ratio of total silica to binder, by weight, is preferably in the range of 3:1 to 15:1 silica to binder and is more preferably 4:1 to 5:1 If the ratio is smaller than 3:1, there is too little silica present so that some sticking occurs. However, if the silica to binder ratio exceeds about 15:1, the thermal sensitivity of the color-forming layer may be decreased.

The coating amount of the protective topcoat layer is in the range of about 100 to 250 mg/ft$^2$.

The colloidal silicas used in the present invention are produced commercially and are an aqueous colloidal dispersion of sub-micron sized silica particles in the form of tiny spheres of a specified average diameter. Preferably, the colloidal silicas are aqueous alkaline dispersions, e.g., ammonia stabilized colloidal silica. The fumed colloidal silicas used in the present invention are aqueous dispersions of fumed colloidal silica commercially available under the name Cab-O-Sperse® from Cabot Corporation, Cab-O-Sil Division, Tuscola, Ill. Colloidal silicas and fumed colloidal silicas low in sodium content are preferred since sodium can cause corrosion of the thermal printhead.

The protective topcoat may contain an organofunctional silane having the formula $RSi(OH)_3$ wherein R represents a nonhydrolyzable organofunctional group. Alternatively, an organofunctional silane may be added as a separate layer on top of the protective layer. Preferably, an organofunctional silane is employed when fused colloidal silica is utilized in the topcoat. The organofunctional silane contains reactive silanol groups that can bond to the silica in the topcoat, while the R group is chosen so that it will covalently bond to pendant organofunctional groups on the polymeric binder used in the topcoat. Thus, the organofunctional silane is added to react with both the silica and binder(s) in the topcoat, functioning as a coupling agent to join the two and thereby reinforce and strengthen the silica/polymeric binder matrix. This reinforced silica/polymeric binder matrix improves the scratch resistance of the recorded image and helps to reduce head build-up. Head build-up occurs when components in the topcoat adhere to and build up on the thermal printhead during printing. Head build-up can cause damage to both the image and to the thermal printhead.

As mentioned above, the organofunctional silane is selected so that it will form a stable covalent bond with the chosen polymeric binder in the protective topcoat layer. For example, if the polymeric binder contains pendant carboxylic acid groups, an organofunctional silane containing an amino functionality would be a good choice since the two will react covalently to form an amide. If the polymeric binder contains pendant hydroxy or urethane groups, an organosilane containing an epoxy functionality would be a suitable choice to form a covalent bond.

The organofunctional silane is added to the topcoat or coated as a separate overcoat layer as an aqueous dispersion. The amount of organofunctional silane employed is calculated to yield a coating coverage in the range of 5–30 mg/ft$^2$ after drying.

When the organofunctional silane is added in with the topcoat, it can be added in its hydrolyzed form, represented by $RSi(OH)_3$ or in an unhydrolyzed form, represented by $RSi(X)$, wherein R is a non-hydrolyzable organofunctional group and X is a hydrolyzable group that may be an alkoxy, acyloxy, amine or chlorine group. Preferably, X is an alkoxy group. When added in its unhydrolyzed form, X is hydrolyzed in situ to form $RSi(OH)_3$.

The protective topcoat may contain other additives provided the additives do not hinder the antistick function of the topcoat layer, do not damage the printhead or other wise impair image quality. Such additives include lubricants, e.g., waxes, polymeric fluorocarbons and metal soaps; surfactants, preferably nonionic surfactants and more preferably nonionic fluorosurfactants; plasticizers; anti-static agents; and ultraviolet absorbers.

The transparent supports that can be used in the present invention may be comprised of various materials and numerous suitable support substrates are known in the art and are commercially available. Examples of materials suitable for use as support substrates include polyesters, polycarbonates, polystyrenes, polyolefins, cellulose esters, polysulfones and polyimides. Specific examples include polypropylene, cellulose acetate, and most preferably, polyethylene terephthalate. The thickness of the support substrate is not particularly restricted, but should generally be in the range of about 2 to 10 mils. The support substrate may be pretreated to enhance adhesion of the polymeric coating thereto.

The di- and triarylmethane thiolactone compounds used as the dye precursors in the present invention may be represented by the formula

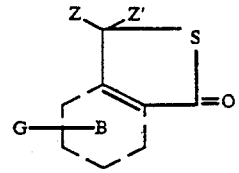

wherein ring B represents a substituted or unsubstituted carbocyclic aryl ring or rings, e.g., of the benzene or naphthalene series or a heterocyclic ring, e.g., pyridine or pyrimidine; G is hydrogen or a monovalent radical; and Z and Z' taken individually represent the moieties to complete the auxochromophoric system of a diarylmethane or a triarylmethane dye when said S-containing ring is open and Z and Z' taken together represent the bridged moieties to complete the auxochromophoric system of a bridged triarylmethane dye when said S-containing ring is open, i.e., when the ring sulfur atom is not bonded to the meso carbon atom. Usually, at least one of Z and Z' whether taken individually or together possesses as an auxochromic substituent, a nitrogen, oxygen or sulfur atom or a group of atoms containing nitrogen, oxygen or sulfur.

In the triarylmethane compounds represented in formula I above, the moieties Z and Z', when taken individually, may be the same or different and typically represent heterocyclic groups containing nitrogen, oxygen or sulfur as the heterocyclic atom, particularly N-heterocyclic groups such as julolidin-3-yl, indol-3-yl, pyrr-2-yl, carbazol-3-yl, and indolin-5-yl wherein the N atom of the indolyl, pyrryl, carbazolyl and indolinyl groups may be substituted with hydrogen or alkyl having 1 to 6 carbon atoms, or the moieties Z and Z' typically may be carbocyclic aryl, particularly phenyl or naphthyl groups which include an appropriately positioned auxochromic substituent, i.e., an atom or group that produces an auxochromic effect, which substituent is usually positioned para to the meso carbon atom. Typically, Z and Z' when taken together represent aryl groups bridged by a heteroatom, such as, oxygen, sulfur or nitrogen to form, for example, 4H-chromeno [2,3-C] pyrazole and particularly represent carbocyclic aryl groups, such as, phenyl groups bridged with a heteroatom, preferably oxygen, sulfur or nitrogen substituted with hydrogen or an alkyl group having 1 to 6 carbon atoms to provide a xanthene, thioxanthene or an acridine dye, which dyes possess an auxochromic substituent(s) para to the meso carbon atom, i.e., in the 3-position or in the 3,6-positions or meta and para to the meso carbon atom, i.e., in the 3,7-positions.

In the diarylmethane compounds, one of Z and Z' may be a heterocyclic group or carbocyclic aryl group as discussed above and the other of Z and Z' may be, for example, phenoxy, thiophenoxy, alkoxy containing 1 to 20 carbon atoms, alkylthio containing 1 to 20 carbon atoms, -N,N-(disubstituted)amino wherein each said substituent may be alkyl containing 1 to 20 carbon atoms, carbocyclic aryl containing 6 to 12 carbon atoms, aralkyl containing 7 to 15 carbon atoms particularly phenyl- and naphthyl-substituted alkyl or alkaryl containing 7 to 15 carbon atoms particularly alkyl-substituted phenyl and naphthyl. Representative alkyl groups include methyl, butyl, hexyl and octadecyl and representative aryl groups include phenyl and naphthyl. Representative alkaryl groups include p-octylphenyl, o-methylnaphthyl and p-hexylphenyl, and representative aralkyl groups include phenethyl, benzyl and naphthylmethyl.

Examples of useful auxochromic substituents include $—OR_1$ wherein $R_1$ is hydrogen, alkyl usually having 1 to 6 carbon atoms, aralkyl usually having 7 to 15 carbon atoms, alkaryl usually having 7 to 15 carbon atoms or carbocyclic aryl usually having 6 to 12 carbon atoms; $—SR_2$ wherein $R_2$ has the same meaning given for $R_1$; $—NR_3R_4$ wherein $R_3$ and $R_4$ each represent hydrogen, alkyl usually having 1 to 6 carbon atoms, β-substituted ethyl, cycloalkyl usually having 5 to 7 carbon atoms, aralkyl usually having 7 to 15 carbon atoms, alkaryl usually having 7 to 15 carbon atoms or

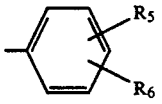

wherein $R_5$ and $R^6$ each are hydrogen, alkyl usually having 1 to 6 carbon atoms, halo such as chloro, bromo, fluoro and iodo, nitro, cyano, alkoxycarbonyl wherein said alkoxy has 1 to 6 carbon atoms, sulfonamido ($—NHSO_2R_0$), sulfamoyl ($—SO_2NHR_0$), sulfonyl ($—SO_2R_0$), acyl ($—COR_0$) or carbamyl ($—CONR_0$) wherein $R_0$ usually is alkyl having 1 to 20 carbon atoms, benzyl or phenyl and $R_3$ and $R_4$ taken together represent the atoms necessary to complete a heterocyclic ring usually piperidino, pyrrolidino, N-methylpiperidino, morpholino or

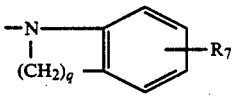

wherein q is an integer 2 to 5 and $R_7$ has the same meaning as $R_5$,

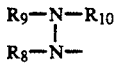

wherein $R_8$ and $R_9$ each are hydrogen, alkyl usually having 1 to 6 carbon atoms or

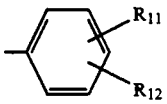

wherein $R_{11}$ and $R_{12}$ have the same meaning as $R_5$ and $R_6$ and $R_{10}$ is $—COR_{13}$, $—CSR_{13}$ or $—SO_2R_{13}$ wherein $R_{13}$ is hydrogen, alkyl usually having 1 to 6 carbon atoms, phenyl, $—NH_2$, $—NHR_{14}$, $—N(R_{14})_2$ or $—OR_{14}$ wherein $R_{14}$ is hydrogen, alkyl usually containing 1 to 6 carbon atoms or phenyl. Representative alkyl groups include methyl, ethyl, propyl, butyl and hexyl. Representative β-substituted ethyl groups include β-methoxymethoxyethyl and β-2'-tetrahydropyranyloxyethyl. Representative aralkyl groups include phenyl and naphthyl-substituted alkyl, such as, benzyl, phenethyl and naphthylmethyl and representative alkaryl groups include alkyl-substituted phenyl and naphthyl, such as, o-methylphenyl, o-methylnaphthyl and p-hexylphenyl. Representative carbocyclic aryl groups include phenyl and naphthyl and representative cycloalkyl groups include cyclopentyl, cyclohexyl and cycloheptyl. It will be appreciated that the auxochromic substituent(s) will be selected for a given diarylmethane, triarylmethane or bridged triarylmethane compound to provide the desired chromophore color upon opening of the S-containing ring and to achieve facile color formation.

In addition to the auxochromic substituents, the subject dye precursor compounds may possess one or more additional substituents on Z and/or Z' and/or ring B as may be desired that do not interfere with the intended utility for the dye. Typical substituents for Z and/or Z' and for G include carboxy; hydroxy; cyano; thiocyano; mercapto; sulfo; nitro; sulfonamido ($—NHSO_2R_0$); sulfamoyl ($—SO_2NHR_0$); sulfonyl ($—SO_2R_0$); acyl ($—COR_0$); carbamyl ($—CONR_0$); halomethyl such as trifluoromethyl; alkyl usually having 1 to 20 carbon atoms such as methyl, octyl, hexadecyl; alkoxy usually having 1 to 20 carbon atoms such as methoxy, ethoxy, propoxy and butoxy; alkoxycarbonyl having 1 to 20 carbon atoms such as ethoxy- and dodecyloxycarbonyl; aralkyl usually having 7 to 15 carbon atoms, for example, phenyl- or naphthyl-substituted alkyl such as benzyl, phenethyl and naphthylmethyl; alkaryl usually having 7 to 15 carbon atoms, for example, alkyl substituted phenyl or naphthyl such as o-methylphenyl, o-methylnaphthyl and p-hexylphenyl; aralkyloxy usually having 7 to 15 carbon atoms, for example, phenyl- or naphthyl-substituted alkoxy such as benzyloxy, phenethyloxy and naphthylmethyloxy; aryloxy usually containing 6 to 12 carbon atoms such as phenoxy and naphthoxy; thioalkyl groups, usually having 1 to 20 carbon atoms such as methylthio, ethylthio and hexylthio; thioaryl and thioaralkyl groups containing up to 15 carbon atoms such as phenylthio, naphthylthio, benzylthio and phenethylthio; halo such as chloro, bromo, fluoro and iodo; amino including mono- and disubstituted amino such as $-NR_{15}R_{16}$ wherein $R_{15}$ and $R_{16}$ each are hydrogen, alkyl usually having 1 to 20 carbon atoms, aralkyl usually having 7 to 15 carbon atoms and aryl having 6 to 12 carbon atoms; and a fused substituent such as a fused benzene ring.

In a preferred embodiment, B is a benzene ring and Z and Z' taken individually or together complete the auxochromophoric system of a triarylmethane dye.

The dye precursor compounds used in the present invention can be monomeric or polymeric compounds. Suitable polymeric compounds are those which, for example, comprise a polymeric backbone chain having dye precursor moieties attached directly thereto or through pendant linking groups. Polymeric compounds of the invention can be provided by attachment of the dye precursor moiety to the polymeric chain via the Z and/or Z' moieties or the ring B. For example, a monomeric dye precursor compound having a reactable substituent group, such as an hydroxyl or amino group, can be conveniently reacted with a mono-ethylenically unsaturated and polymerizable compound having a functional and derivatizable moiety, to provide a polymerizable monomer having a pendant dye precursor moiety. Suitable mono-ethylenically unsaturated compounds for this purpose include acrylyl chloride, methacrylyl chloride, methacrylic anhydride, 2-isocyanatoethyl methacrylate and 2-hydroxyethyl acrylate, which can be reacted with an appropriately substituted dye precursor compound for production of a polymerizable monomer which in turn can be polymerized in known manner to provide a polymer having the dye precursor compound pendant from the backbone chain thereof.

The thiolactone dye precursors can be synthesized, for example, from the corresponding lactones by heating substantially equimolar amounts of the lactone and phosphorus pentasulfide or its equivalent in a suitable solvent. The silver behenate may be prepared in a conventional manner using any of various procedures well known in the art.

The organic silver salts which can be employed in the color-forming system of the present invention include silver salts of long chain aliphatic carboxylic acids such as silver laurate, silver myristate, silver palmitate, silver stearate, silver arachidate and silver behenate; silver salts of organic compounds having an imino group such as benzotriazole silver salt, benzimidazole silver salt, carbazole silver salt and phthalazinone silver salt; silver salts of sulfur containing compounds such as S-alkylthioglycollates; silver salts of aromatic carboxylic acids such as silver benzoate and silver phthalate; silver salts of sulfonic acids such as silver ethanesulfonate; silver salt of sulfinic acids such as silver o-toluenesulfinate; silver salts of phosphoric acids such as silver phenylphosphate; silver barbiturate; silver saccharate; silver salts of salicylaldoxime; and any mixtures thereof. Of these compounds, silver salts of long chain aliphatic carboxylic acids are preferred and particularly, silver behenate which may be used in admixture with other organic silver salts if desired. Also, behenic acid may be used with the silver behenate.

The preparation of such organic silver salts is generally carried out by processes which comprise mixing a silver salt forming organic compound dispersed or dissolved in a suitable liquid with an aqueous solution of a silver salt such as silver nitrate or a silver complex salt. Various procedures for preparing the organic silver salts are described in U.S. Pat. Nos. 3,458,544, 4,028,129 and 4,273,723.

The heat-fusible organic acidic material which can be employed in this invention is usually a phenol or an organic carboxylic acid, particularly a hydroxy-substituted aromatic carboxylic acid, and is preferably 3,5-dihydroxybenzoic acid. A single heat-fusible organic acid can be employed or a combination of two or more may be used.

The present invention is illustrated by the following specific examples. Examples 1–4 represent recording elements prepared by coating various topcoat formulations according to the present invention over the identical imaging system. Examples 5–9 represent comparative topcoat formulations coated over the imaging system used in Examples 1–4. Examples 10–12 represent additional recording elements prepared by coating topcoat formulations containing fumed colloidal silica according to the present invention over the same imaging system used in the previous eight examples.

The imaging system employed in each of the examples was prepared by coating Layer One onto a transparent 2.65 mil polyethylene terephthalate substrate pretreated with a solvent adherable subcoat (ICI 505, commercially available from ICI Americas, Inc., Wilmington, Del.) by the slot method, followed by air drying. Layer Two was then coated on top of Layer One in the same manner and air dried. It will be appreciated that while slot coating was employed, any appropriate coating method could be used, e.g. spray, air knife, silkscreen or reverse roll. Both Layer One and Layer Two were coated from a solvent mixture comprised of 80% of methyl ethyl ketone and 20% of methyl phenyl ketone. The amounts of components used in each of the layers were calculated to give, after drying, the indicated coated coverages.

| | Coverage (mg/ft$^2$) |
|---|---|
| Layer One: | |
| Polyvinylbutyral | 300 |
| Silver behenate dispersion (in polyvinylbutyral) | 120 (as silver behenate) |
| 3,5-Dihydroxybenzoic acid | 54 |
| 3,5-Diisopropylsalicylic acid | 4 |
| Layer Two: | |
| Polyvinylbutyral (Butvar B-76, available from Monsanto, St. Louis, Mo.) | 150 |
| Blue Dye Precursor | 1 |
| Red Dye Precursor | 5 |
| Black Dye Precursor | 40 |

Blue Dye Precursor

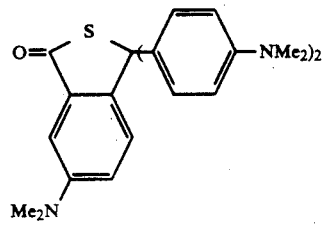

Red Dye Precursor

-continued

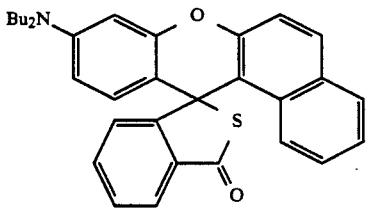

Black Dye Precursor

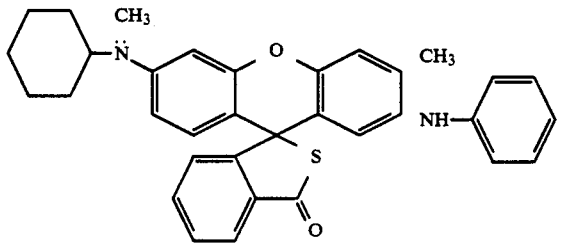

Each of the following Examples describes a topcoat formulation which was prepared and coated, either as an aqueous dispersion or as an aqueous solution, over the above described imaging system. The amounts of components used in each topcoat formulation were calculated to give the indicated coated coverages.

EXAMPLE 1

| | Coverage (mg/ft$^2$) |
|---|---|
| NeoRez R966 Polyurethane Latex (33% total solids (TS), available from ICI Resins, Wilmington, MA) | 23 |
| Nyacol 5050, 50 nm Silica dispersion (50% TS, available from Nyacol Products, Inc., Ashland, MA) | 54 |
| Nalco 2327, 20 nm Silica dispersion (40% TS, available from Nalco Chemical Co., Naperville, IL) | 31 |
| Nalco 2326, 5 nm Silica dispersion (17% TS, available from Nalco Chemical Co.) | 31 |
| Hostaflon 5032, polytetrafluoroethylene dispersion, (60% TS, available from Hoechst-Celanese, Chatham, NJ) | 15 |
| Zonyl FSN, perfluoroalkyl polyethylene oxide non-ionic surfactant available from DuPont, Wilmington, DE) | 6 |

EXAMPLE 2

| | Coverage (mg/ft$^2$) |
|---|---|
| Scripset 540 (a half ester of styrene maleic anhydride copolymer in a 5% $NH_3$, available from Monsanto, St. Louis, MO) | 20 |
| Carboset 526 (a carboxylated acrylic copolymer in $NH_3$, available from B F Goodrich, Cleveland, OH) | 10 |
| Nyacol 5050, 50 nm silica | 110 |
| Nalco 2327, 20 nm silica | 20 |
| Nalco 2326, 5 nm silica | 20 |
| Hostaflon 5032 | 20 |
| Zonyl FSN | 8 |

EXAMPLE 3

| | Coverage (mg/ft$^2$) |
|---|---|
| Scripset 540 | 20 |
| Carboset 526 | 10 |
| Nalco 2327, 20 nm silica | 110 |
| Nalco 2326, 5 nm silica | 40 |
| Hostaflon 5032 | 10 |
| Zonyl FSN | 5 |

EXAMPLE 4

| | Coverage (mg/ft$^2$) |
|---|---|
| Scripset 540 | 20 |
| Carboset 526 | 10 |
| Nyacol 5050, 50 nm silica | 110 |
| Nalco 2327, 20 nm silica | 20 |
| Nalco 2326, 5 nm silica | 20 |
| Zonyl FSN | 5 |

EXAMPLE 5

A recording element was prepared according to example 4, above, and was subsequently coated with an aqueous oligomeric aminosilane solution, commercially available under the tradename Hydrosil® 2627, from Hüls America, Inc., Bristol, Pa. and dried at 145° F. (~63° C.) to yield a coated coverage of 5 mg/ft$^2$.

EXAMPLE 6

| | Coverage (mg/ft$^2$) |
|---|---|
| Scripset 540 | 20 |
| Carboset 526 | 10 |
| Nalco 2326, 5 nm Silica | 150 |
| Hostaflon 5032 | 20 |
| Zonyl FSN | 8 |

EXAMPLE 7

| | Coverage (mg/ft$^2$) |
|---|---|
| Scripset 540 | 30 |
| Nalco 2327, 20 nm silica | 150 |
| Hostaflon 5032 | 20 |
| Zonyl FSN | 8 |

EXAMPLE 8

| | Coverage (mg/ft$^2$) |
|---|---|
| NeoRez R966 | 20 |
| Nalco 2326, 5 nm silica | 160 |
| Hostaflon 5032 | 20 |
| Zonyl FSN | 12 |

EXAMPLE 9

| | Coverage (mg/ft$^2$) |
|---|---|
| Scripset 540 | 20 |
| Carboset 526 | 10 |
| Nyacol 9950, 100 nm Silica | 150 |
| Hostaflon 5032 | 20 |
| Zonyl FSN | 8 |

EXAMPLE 10

| | Coverage (mg/ft$^2$) |
|---|---|
| Scripset 540 | 20 |
| Carboset 526 | 10 |
| Nyacol 9950, 100 nm silica | 110 |
| Nalco 2327, 20 nm silica | 20 |
| Nalco 2326, 5 nm silica | 20 |
| Hostaflon 5032 | 20 |
| Zonyl FSN | 8 |

EXAMPLE 11

| | Coverage (mg/ft$^2$) |
|---|---|
| Scripset 540 | 20 |
| Carboset 526 | 10 |
| Nalco 2326, 5 nm silica | 80 |
| Cab-O-Sperse A205 (a fumed colloidal silica having an average particle diameter of 14 nm, available from Cabot Corporation, Cab-O-Sil Division, Tuscola, IL) | 70 |
| Hostaflon 5032 | 10 |
| Zonyl FSN | 5 |

EXAMPLE 12

| | |
|---|---|
| Scripset 540 | 20 |
| Carboset 526 | 10 |
| Nalco 2326, 5 nm silica | 80 |
| Cab-O-Sperse A205 | 70 |
| Hostaflon 5032 | 10 |
| Zonyl FSN | 5 |
| γ-Aminopropyltriethoxysilane (available from Hüls America, Inc., Bristol, PA) | 5 |

EXAMPLE 13

| | |
|---|---|
| Scripset 540 | 24 |
| Carboset 526 | 12 |
| Nalco 2326, 5 nm silica | 96 |
| Cab-O-Sperse A205 | 84 |
| Hostaflon 5032 | 3 |
| Zonyl FSN | 6 |

The above coated material was subsequently coated with Hydrosil ® 2627, an aqueous oligomeric aminosilane solution, and dried at 145° F. (~63° C.) to yield a coated coverage of 5 mg/ft$^2$.

The recording elements prepared according to examples 1-13, above, were each imaged by means of a commercially available thermal printer, Model VP-3500, sold by Seikosha America, Inc., Mahwah, N.J. The % haze, the scratch resistance, and the amount of crazing were determined for each film. The results are recorded in Table 1.

The haze measurements were determined using a Spectrogard II Spectrophotometer made by Gardner-Neotec Instruments, Silver Spring, Md.

Scratch resistance was determined by the resistance of each image to fingernail scratching. "Excellent" describes those images where no scratching was observed; "good" describes those images where scratching was observed, but it had no detrimental impact on image quality; "poor" describes those printed images that were very susceptible to scratching and the scratching was detrimental to image quality; and "fair" describes films whose scratch resistance fell between the good and poor films.

Crazing was ascertained visually. Crazing occurs upon drying of the topcoat after it has been coated on the color-forming layer and is, therefore, present before imaging. "High" describes those recorded images that were extremely crazed and "low" describes those recorded images where the image appeared substantially craze-free.

TABLE I

| Example | % Haze | Scratch Resistance | Crazing |
|---|---|---|---|
| 1 | 4.2 | good | low |
| 2 | 4.5 | good | low |
| 3 | 4.5 | good | low |
| 4 | 3.6 | good | low |
| 5 | 4.0 | excellent | low |
| 6 | 11.8 | excellent | high |
| 7 | 5.5 | poor | low |
| 8 | 7.7 | good | high |
| 9 | 7.3 | poor | low |
| 10 | 6.5 | fair | low |
| 11 | 9.0 | excellent | low |
| 12 | 8.0 | excellent | low |
| 13 | 9.3 | excellent | low |

As can be seen from the results shown in Table I, the thermographic recording films of Examples 1-5 according to the present invention were superior overall to comparative Examples 6-9 which employed only one silica of specified average particle diameter in the topcoat formulation. Examples 11-13 were superior in terms of scratch resistance (fingernail) and crazing, although the haze was higher for these examples which utilized fumed colloidal silica when compared with other topcoat formulations according to the present invention.

When only very small silica was used, as in examples 6 and 8 (average silica particle diameter of 5 nm), the crazing was extremely high and there was an increased level of haze. It should be noted that the presence of crazing increases the level of measured haze.

Where only silica having an average particle diameter of 20 nm was employed, as in Example 7, the recorded image was susceptible to scratching and the haze was slightly greater than for the topcoats according to the present invention.

When only silica having an average particle diameter of 100 nm was employed, as in Example 9, the recorded image was very susceptible to scratching and the haze was greater than for the recorded images of examples 1-5.

When a mixture of silicas was employed in the topcoat formulation and the largest silica had an average particle diameter of 100 nm, as in Example 10, the resulting film had less scratch resistance than the topcoats according to this invention and the haze was higher than examples 1-5 according to the present invention.

Where fumed colloidal silica and/or an organofunctional silane was employed, as in examples 5 and 11-13, the recorded image was very resistant to fingernail scratching while also being substantially free of crazing.

When an organofunctional silane was added to the topcoats of this invention, as exemplified in examples 5, 12 and 13, the thermal printhead was substantially free of head build-up after printing.

Inorganic silica films comprising mixtures of silicas such as disclosed in U.S. Pat. No. 2,956,958 and described in Iler, R. K., The Chemistry of Silica, John Wiley & Sons, New York, 1979, particularly at pp. 369–371, which require 1 part silica having an average particle diameter larger than 50 nm with the average particle diameter in the range from 50 to 150 nm, would have higher levels of haze and/or be more susceptible to scratching than the topcoats of the present invention.

Since certain changes may be made in the above subject matter without departing from the spirit and scope of the invention herein involved, it is intended that all matter contained in the above description and the accompanying examples be interpreted as illustrative and not in any limiting sense.

We claim:

1. A transparent thermographic recording film comprising a transparent support carrying:

(a) a dye image-forming system comprising a di- or triarylmethane thiolactone dye precursor, an organic silver salt, a heat-fusible organic acidic material, and polyvinylbutyral as the binder; and, (b) a protective topcoat layer positioned above said dye image-forming system and comprising a water-insoluble polymeric binder, a mixture of at least two colloidal silicas having different average particle diameters in the proportion, by weight, of 1 part of larger silica having an average diameter of 50 nm or smaller and 0.3 to 1 part of silica particles having an average diameter no more than 40% of the larger sized silica particles, the ratio of total silica to binder being at least 3 parts per weight silica to 1 part per weight binder.

2. A thermographic recording film according to claim 1 wherein the largest of said silica particles has an average diameter of 50 nm.

3. A thermographic recording film according to claim 1 wherein said organic silver salt, polyvinylbutyral binder and heat-fusible organic acidic material are carried in a layer on said transparent support and said di- or triarylmethane thiolactone dye precursor is in the same or an adjacent layer.

4. A thermographic recording film according, to claim 1 wherein organic silver salt, polyvinylbutyral binder and heat-fusible organic acidic material are carried in a layer on said transparent support and said di- or triarylmethane thiolactone dye precursor is in an adjacent layer.

5. A thermographic recording film according to claim 1 wherein said protective topcoat further comprises a lubricating agent.

6. A thermographic recording film according to claim 5 wherein said lubricating agent is polytetrafluoroethylene.

7. A thermographic recording film according to claim 1 wherein said protective topcoat further comprises a surfactant.

8. A thermographic recording film according to claim 7 wherein said surfactant is a nonionic surfactant.

9. A thermographic recording film according to claim 7 wherein said surfactant is a nonionic fluorosurfactant.

10. A thermographic recording film according to claim 1 wherein said water-insoluble polymeric binder for said protective topcoat layer is an aliphatic polyurethane.

11. A thermographic recording film according to claim 1 wherein said topcoat further comprises a second water-insoluble polymeric binder.

12. A thermographic recording film according to claim 1 wherein said silica to binder ratio is from 4:1 to 6:1.

13. A thermographic recording film according to claim 1 wherein said silica to binder ratio is 5:1.

14. A thermographic recording film according to claim 1 wherein said silica to binder ratio is no greater than 15:1.

15. A thermographic recording film according to claim 1 wherein said topcoat comprises a mixture of 3 different sized silica particles in the proportion by weight of 1 part of silica particles having an average diameter of 50 nm or smaller, and 0.2 to 0.6 part of silica particles having an average diameter no more than of the larger sized particles, and 0.2 to 0.6 part of silica particles having an average diameter of no more than 8 nm.

16. A thermographic recording film according to claim 15 wherein said topcoat comprises a mixture of 1 part silica having an average diameter of 50 nm, 0.6 part of silica having an average diameter of 20 nm and 0.6 part of silica having an average diameter of 5 nm.

17. A thermographic recording film according to claim 15 wherein said organic silver salt is silver behenate.

18. A thermographic recording film according to claim 15 wherein said heat-fusible organic acidic material is 3,5-dihydroxybenzoic acid.

19. A thermographic recording film according to claim 15 wherein said dye image-forming system further comprises a second heat-fusible organic acidic material.

20. A thermographic recording film according to claim 1 wherein one of said colloidal silicas is a fumed colloidal silica having an average particle diameter in the range of 14 nm to 30 nm.

21. A thermographic recording film according to claim 1 wherein one of said colloidal silicas is fumed colloidal silica having an average diameter of 14 nm.

22. A thermographic recording film according to claim 21 wherein the second colloidal silica is a colloidal silica having an average particle diameter of 5 nm.

23. A thermographic recording film according to claim 22 wherein said protective topcoat layer additionally comprises an organofunctional silane.

24. A thermographic recording film according to claim 22 which additionally comprises a layer of an organofunctional silane on top of said protective topcoat layer.

25. A thermographic recording film according to claim 1 wherein said protective topcoat additionally comprises an organofunctional silane.

26. A thermographic recording film according to claim 1 which additionally comprises a layer of an organofunctional silane on top of said protective topcoat layer.

* * * * *